US007367735B2

(12) United States Patent
Kanari

(10) Patent No.: US 7,367,735 B2
(45) Date of Patent: May 6, 2008

(54) HAND-HELD INSTRUMENT HAVING VARIABLE CONTOUR GRIP

(75) Inventor: Hiroyuki Kanari, Fukushima-Ken (JP)

(73) Assignee: Micro Co., Ltd. (JP)

( * ) Notice: Subject to any disclaimer, the term of this patent is extended or adjusted under 35 U.S.C. 154(b) by 245 days.

(21) Appl. No.: 11/216,394

(22) Filed: Aug. 31, 2005

(65) Prior Publication Data

US 2006/0083576 A1 Apr. 20, 2006

(30) Foreign Application Priority Data

Oct. 15, 2004 (JP) ..... 2004-301131

(51) Int. Cl.
*A46B 5/02* (2006.01)
*A45C 13/32* (2006.01)

(52) U.S. Cl. ..... 401/6; 16/430

(58) Field of Classification Search ..... 401/6, 401/52, 195; 16/430

See application file for complete search history.

(56) References Cited

U.S. PATENT DOCUMENTS 1,868,441 A * 7/1932 Colfelt ..... 15/443
2,576,751 A * 11/1951 Dortmund ..... 91/489
4,035,089 A * 7/1977 Schwartz et al. ..... 401/6
5,263,275 A * 11/1993 Rumbaugh ..... 43/23
6,146,038 A 11/2000 Mittersinker et al. ..... 401/6
7,153,052 B2 * 12/2006 Nakayama et al. ..... 401/6

* cited by examiner

*Primary Examiner*—David J. Walczak
(74) *Attorney, Agent, or Firm*—Adams & Wilks

(57) ABSTRACT

A hand-held instrument has a variable contour grip, a main body having a grip-attaching portion, and a tubular grip body made of a resilient material and mounted around the grip-attaching portion of the main body for undergoing rotation relative thereto. Each of an outer circumferential surface of the grip-attaching portion and an inner circumferential surface of the grip body has a non-circular cross-sectional shape so that when the grip-attaching portion and the grip body are rotated relative to one another, the grip body undergoes deformation so that portions thereof or contracted and other portions thereof are expanded to thereby change an outer configuration or contour of the grip body.

20 Claims, 6 Drawing Sheets

HAND-HELD INSTRUMENT HAVING VARIABLE CONTOUR GRIP

BACKGROUND OF THE INVENTION

1. Field of the Invention

The present invention relates generally to hand-held instruments and, more specifically, to a hand-held instrument, such as a writing instrument (e.g., a mechanical pencil or a ballpoint pen), having a deformable grip section providing a variable contour grip.

2. Background Information

Conventional hand-held instruments include, for example, writing instruments having a tubular grip body of the type to be held between the fingers of the hand for use. Conventional writing instruments of this type having a tubular grip body made of a soft resilient material provided on the grip section of a writing instrument main body are generally known. Further, various types of such conventional writing instruments of which the thickness, position, etc. of the grip body can be changed have been proposed. Since the foregoing structure of the conventional writing instruments has been adopted primarily for the purpose of increasing or decreasing a diameter of the grip body, a cross-section of the grip body still maintains a circular shape. Furthermore, in order to deform the grip body into a shape other than a circular shape, it is required to provide a means for pressing the grip body in the axial direction of the writing instrument main body as disclosed in U.S. Pat. No. 6,146,038. Accordingly, the resulting structure of the foregoing conventional writing instruments has been complex and expensive to manufacture.

SUMMARY OF THE INVENTION

It is an object of the present invention to provide a hand-held instrument having a variable contour grip and a simple construction, and in which a cross-section of a grip body can be changed to a shape other than a circular shape and for which no pressing means for moving the grip body in the axial direction of the hand-held instrument main body is required as compared to conventional hand-held instruments.

It is another object of the present invention to provide a hand-held instrument in the form of a writing instrument having a variable contour grip.

It is another object of the present invention to provide a hand-held instrument, such as a writing instrument, having a variable contour grip and which is simple and economical to manufacture.

The foregoing and other objects of the present invention are carried out by a hand-held instrument having a variable contour grip. The hand-held instrument comprises a main body having a grip-attaching portion, and a grip body which is made of a resilient material, formed in a tubular shape, and fitted around the grip-attaching portion. The outer configuration of the grip-attaching portion and the inner configuration of the grip body are shaped to have a non-circular cross-section so that when the grip-attaching portion and the grip body are rotated relative one another, the grip body undergoes deformation so that portions thereof or contracted and other portions thereof are expanded, and the outer configuration of the grip body is changed. An outer surface or face of the grip-attaching portion has a distant face portion (first surface portion) spaced from the axis of the main body and a retracting face portion (second surface portion) disposed closer to the axis than the distant face portion. A columnar body protruding along the outer face of the grip-attaching portion is formed on the inner face of the grip body. When the columnar body is seated on the retracting face portion, the outer configuration of the grip body has a circular shape, and when the columnar body is seated on the distant face portion, the outer configuration of the grip body has a non-circular shape.

The hand-held instrument of the present invention also provides, between the grip-attaching portion and the grip body, holding means for holding the grip body at its rotated position when the columnar body is seated on the distant face portion or the retracting face portion.

In the hand-held instrument of the present invention, since the outer face of the grip-attaching portion of the main body and the inner face of the grip body are made to have a non-circular cross-section, the grip body can be deformed by changing the fitting condition of the grip-attaching portion and the grip body by rotating the grip body. Further, the outer face of the grip-attaching portion is made to have a non-circular cross-section which has the distant face portion spaced from the axis of the main body and the retracting face portion disposed closer to the axis than the distant face portion. The columnar body is formed on the inner face of the grip body so as to protrude along the outer face of the grip-attaching portion. The grip body is rotatably provided on the grip-attaching portion so that the columnar body will be seated on the retracting face portion or the distant face portion.

By the foregoing construction of the hand-held instrument according to the present invention, when the grip-attaching portion and the grip body are rotated relative one another, the columnar body is seated on the distant face portion and the outer configuration of the grip body can be deformed to a shape substantially corresponding to the non-circular cross-section of the grip-attaching portion, or the columnar body is seated on the retracting face portion and the outer configuration of the grip body can be returned from the non-circular cross-section to a circular cross-section. Accordingly, for example, when the grip-attaching portion is made to have a cross-section of substantially triangular shape, the grip section of the writing instrument can be deformed to a substantially triangular columnar shape or to a cylindrical shape by rotating the grip body.

When the columnar body is seated on the distant face portion as described above, since a gap is formed between the retracting face portion and the inner face of the grip body, an air cushion effect is achieved when the user grips the grip section of the hand-held instrument during use. If a means for holding the grip body at the rotated position is provided, the grip body does not rotate during use. Thus the hand-held instrument of the present invention can be easily used and obtained at low cost, thereby providing a hand-held instrument having a simple and economical construction.

In another aspect, the hand-held instrument according to the present invention is a writing instrument.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only some forms as examples of the use of the invention. The invention is not intended to be limited to the embodiments so described, and the scope of the invention will be pointed out in the appended claims.

As used herein, the term "hand-held instrument" means a writing instrument such as a pencil, a ballpoint pen or a marker, brushes, makeup instruments, surgical instruments, chisels and cutting blades, scribing and etching tools, styluses and a wide variety of other hand-held instruments which can benefit by a variable contour grip.

The present invention is described below with reference to a particular example wherein the hand-held instrument is a writing instrument, such as a pencil or a ballpoint pen. As another example of the hand-held instrument to which the present invention pertains, the hand-held instrument is a makeup instrument or the like containing a refill in the form of a makeup article configured similarly to a writing refill such as described below for the writing instrument of the present invention. It is understood, however, that the present invention is not limited to a writing instrument or a makeup instrument, but is rather adapted for any of the types of hand-held instruments as defined above and other hand-held instruments which can benefit by a variable contour grip.

Figure 1:
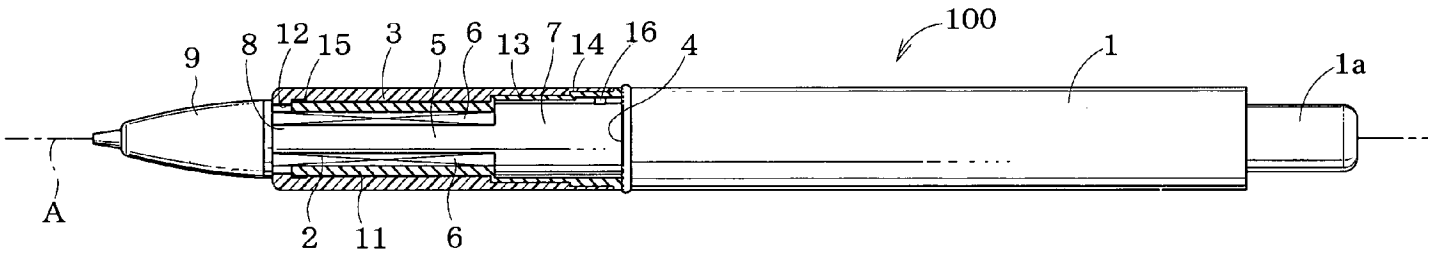
FIG. 1 is a front view of a writing instrument according to an embodiment of the present invention showing a partially cut-away section of a grip section.

Referring now to the drawings in detail, wherein like numerals are used to indicate like elements throughout, there is shown in FIGS. 1-16 embodiments of a hand-held instrument in the form of a writing instrument 100 according to the present invention. FIG. 1 shows an embodiment of the writing instrument 100 with a part of a grip section shown in partial cross-section. The writing instrument 100 has a main body 1 formed with a tubular member in the form of a tubular grip-attaching portion 2. A tubular grip body 3 made of a soft resilient material is fitted around the tubular grip attaching portion 2. The main body 1 accommodates a refill 1*a*, such as for a mechanical pencil, a ballpoint pen, or a marker.

Figure 2:
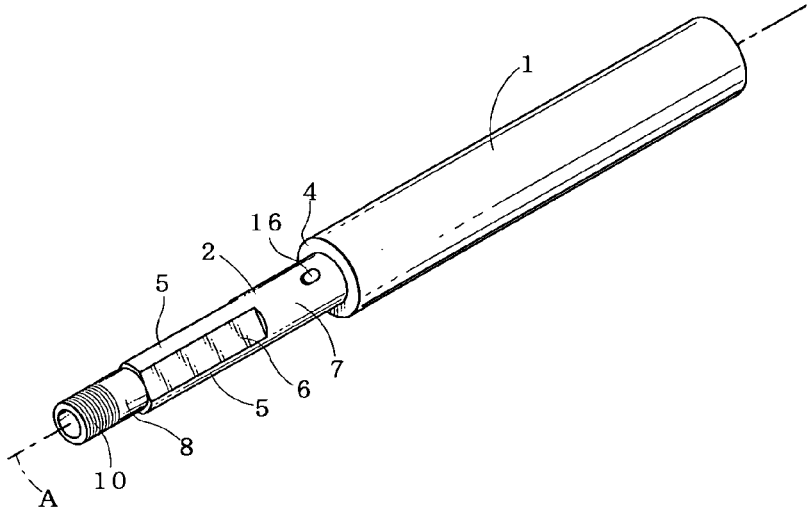
FIG. 2 is a perspective view of a writing instrument main body.
Figure 3:
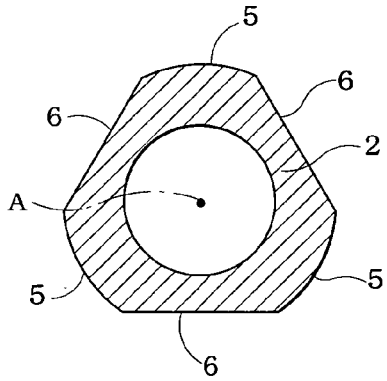
FIG. 3 is an enlarged sectional view of a grip-attaching portion of the writing instrument of FIG. 2.

As shown in FIG. 2, the grip-attaching portion 2 of the main body 1 is shaped to have a small diameter via a stepped portion 4, and the outer configuration thereof is shaped to have a non-circular cross-section. Preferably, the grip-attaching portion 2 is shaped to have a regular polygonal non-circular cross-section having distant face portions 5 (first surface portions) spaced from a longitudinal axis A of the writing instrument main body 1 and retracting face portions 6 (second surface portions) disposed closer to the axis A than the distant face portions 5. As shown in FIG. 3, the grip-attaching portion 2 is preferably formed with a substantially equilateral triangular cross-section and has three of the distant face portions 5 formed by arcuate surfaces and three of the retracting face portions 6 formed by flat surfaces. It will be appreciated by those skilled in the art, however, that the outer configuration of the grip-attaching portion 2 may be formed to have a cross-sectional shape other than equilateral triangular, such as a substantially rectangular, pentagonal, hexagonal, or substantially oval shape or any other appropriate cross-sectional shape, without departing from the spirit and scope of the invention.

Referring back to FIG. 2, the grip-attaching portion 2 has a rear portion formed with a first rotation-supporting portion 7 and a front portion formed with a second rotation-supporting portion 8. Each of the first and second rotation-supporting portions 7, 8 is generally circular in cross-section. A front end of the grip-attaching portion 2 adjacent to the second rotation-supporting portion 8 is formed with a threaded portion 10 for threaded engagement with a mouth piece 9 (FIG. 1) of the writing instrument 100.

Figure 4:
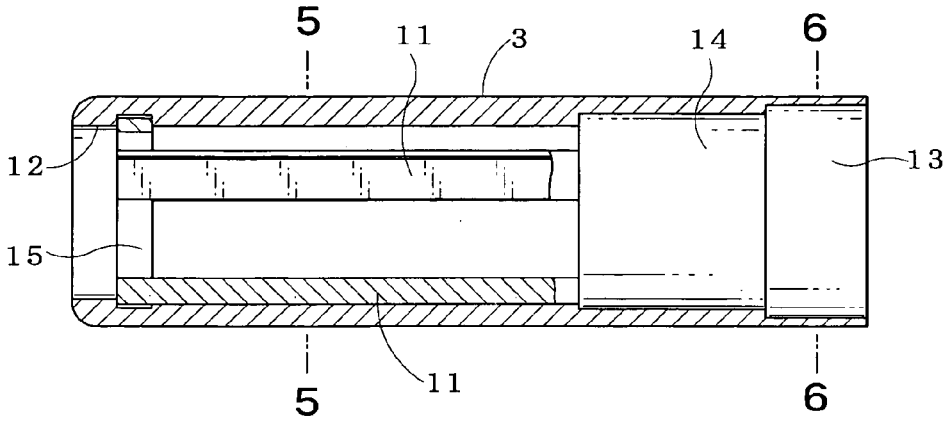
FIG. 4 is an enlarged sectional view of a grip body.
Figure 5:
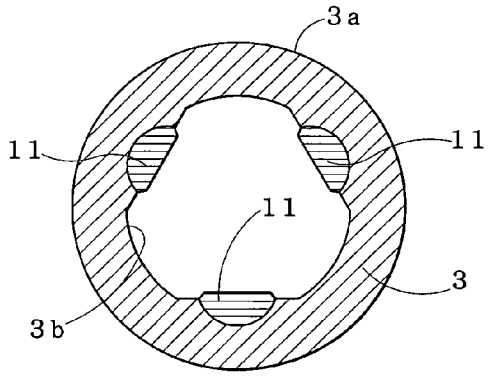
FIG. 5 is an enlarged sectional view taken along line 5-5 of FIG. 4.

With reference to FIG. 4 and FIG. 5, the grip body 3 is made of a soft resilient material having an appropriate hardness, such as a soft plastic material or an elastomer material. The grip body 3 has a tubular construction, an outer face or circumferential surface 3*a* having a generally circular shape, and an inner surface or face 3*b* having a non-circular cross-sectional shape which surrounds an outer surface of the grip-attaching portion 2 when the grip body 3 is fitted around the grip-attaching portion 2.

Preferably, as shown in FIG. 5, protrusions in the form of columnar bodies 11 are formed in and slightly protrude from the inner surface 3*b* of the grip body 3 so as to surround the grip-attaching portion 2 when the grip body 3 is fitted around the grip-attaching portion 2. The number of columnar bodies 11 corresponds to the cross-sectional shape of the grip-attaching portion 2, and in the example shown in FIG. 5, three columnar bodies 11 are provided. The columnar bodies 11 may have the same hardness as the grip body 3, but may be integrally formed together with a soft portion by insert molding or by two-color molding, for example, using a resilient material having a hardness higher than that of the grip body 3. Alternatively, the columnar bodies 11 and the grip body 3 may be formed separately and then assembled together. On the inner surface 3*b* of the grip body 3 at a position ahead of the columnar bodies 11, there is formed a receiving-hole portion 12 having a circular cross-section. The receiving-hole portion 12 is configured to be rotatably fitted to the second rotation-supporting portion 8 of the grip-attaching portion 2.

Figure 7:
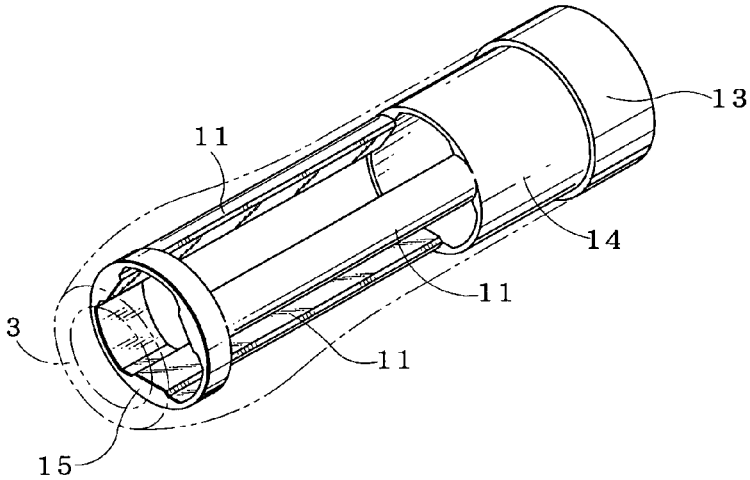
FIG. 7 is a perspective view of an inner bearing member.

Referring to FIG. 7, an inner bearing member 13 is formed at an inward portion of the grip body 3. The inner bearing member 13 is preferably made of a resilient material, such as a plastic material having a hardness higher than that of the grip body 3. The inner bearing member 13 has a supporting tubular portion 14 which is configured to be rotatably fitted to the first rotation-supporting portion 7 of the grip-attaching portion 2. A basal end of each of the columnar bodies 11 is integrally connected to the supporting tubular portion 14. At the front end of the inner bearing member 13, a ring-shaped connecting piece 15 is formed, and the columnar bodies 11 are connected to each other via the connecting piece 15.

The grip body 3 is rotatably attached to the grip-attaching portion 2 so that the columnar bodies 11 will be seated on the respective retracting face portions 6 or the respective distant face portions 5 of the grip-attaching portion 2. Preferably, the writing instrument includes holding means for holding the grip body 3 at its rotated position when the columnar bodies 11 are seated on the respective distant face portions 5 and the retracting face portions 6.

Figure 6:
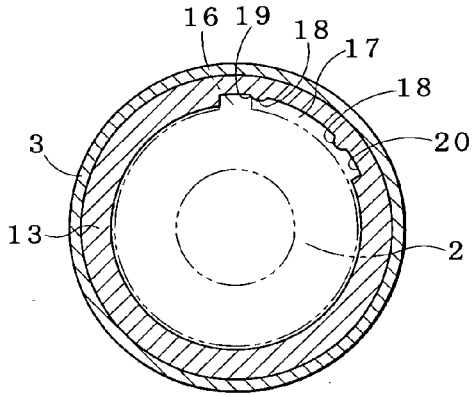
FIG. 6 is an enlarged sectional view taken along line 6-6 of FIG. 4.

According to the present invention, the holding means is selected with an appropriate shape and structure so as to properly function to hold the grip body 3 at its rotated position as described above, For example, in the embodiment of FIGS. 1-12, the holding means comprises an engagement projection 16 and receiving portions 10, 20 for receiving the engagement projection 16. More specifically, as shown in FIG. 2, the engagement projection 16 is provided at the first rotation-supporting portion 7 of the grip-attaching portion 2. As shown in FIG. 6, a groove portion 17 is formed in the circumferential direction of the inner surface of the supporting tubular portion 14 of the inner bearing member 13. Small projections 18 are formed proximate both ends of the groove portion 17. The receiving portions 19 and 20 for receiving the engagement projection 16 are formed adjacent to and contiguous with the respective projections 18. The heights of the projections 18 and the engagement projection 16 are shown to be large in the drawing for the purpose of convenience of explanation, but the heights are actually at such a level that the grip body 3 can ride over the engagement projection 16 when the grip body 3 is positively rotated. Alternatively, the engagement projection 16 may be formed in the grip body 3 and the receiving portions 19 and 20 may be formed in the grip-attaching portion 2. The length of the groove portion 17 corresponds to the length in the circumferential direction of the distant face portions 5 and the retracting face portions 6. Alternatively, the groove portion 17 may be omitted so that the grip body 3 can rotate 360°.

Figure 8:
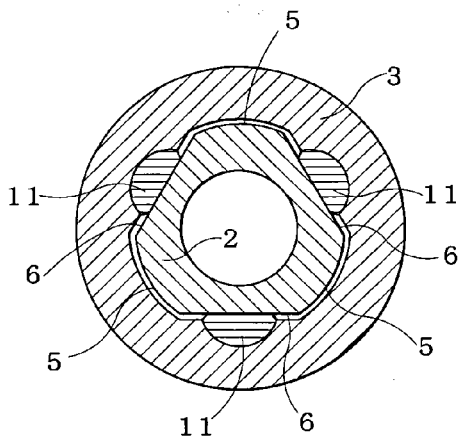
FIG. 8 is an enlarged sectional view of a grip-attaching portion, showing the state where a columnar body is seated on a retracting face portion.
Figure 9:
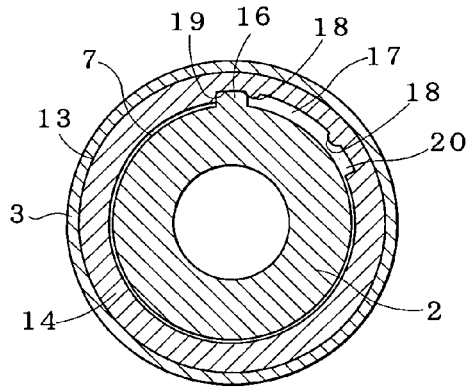
FIG. 9 is an enlarged sectional view of a rotation-supporting portion of the grip-attaching portion of FIG. 8.

The columnar bodies 11 and the retracting face portions 6 are formed to have such a dimension that when the columnar bodies 11 are seated on the respective retracting face portions 6, the outer configuration of the grip body 3 will preferably have a substantially circular cross-section as shown in FIG. 8. As the case requires, the outer configuration of the grip body 3 may have a substantially oval shape or any other appropriate shape. In this state, the engagement projection 16 is engaged with the receiving portion 19 as shown in FIG. 9.

Figure 10:
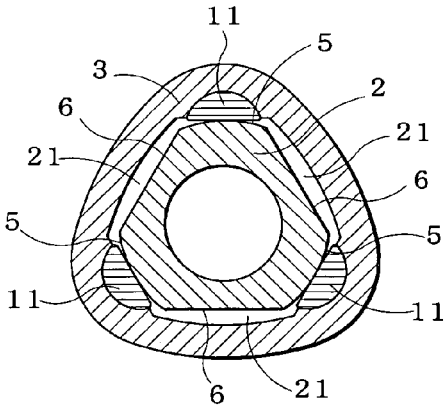
FIG. 10 is an enlarged sectional view of a grip-attaching portion and shows the state where a columnar body is seated on a distant face portion.
Figure 11:
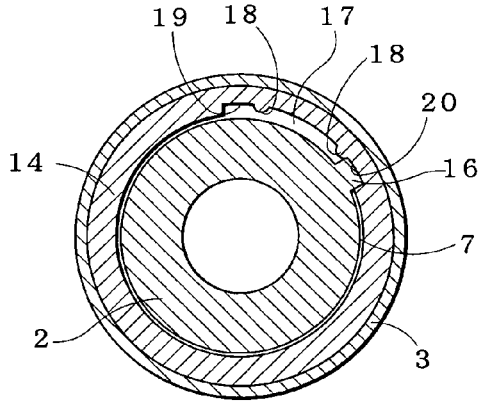
FIG. 11 is an enlarged sectional view of a rotation-supporting portion of the grip-attaching portion of FIG. 10.

Thus the outer configuration of the grip-attaching portion 2 and the inner configuration of the grip body 3 are shaped to have a non-circular cross-section so that when the grip-attaching portion 2 and the grip body 3 are rotated relative one another, the grip body 3 undergoes deformation s that portions thereof are contracted and other portions thereof are expanded, and the outer configuration of the grip body 3 is changed. For example, when the grip body 3 is rotated from the state shown in FIG. 8 and moved to such a position that the columnar bodies 11 are seated on the respective distant face portions 5, the grip body 3 has a substantially triangular cross-section as shown in FIG. 10. In this state, the engagement projection 16 is engaged with the receiving portion 20 as shown in FIG. 11. As described above, since the deformed shape of the grip body 3 corresponds to the cross-section of the grip-attaching portion 2, the grip portion 3 can be deformed to various shapes by changing the cross-section of the grip-attaching portion 2.

Figure 12:
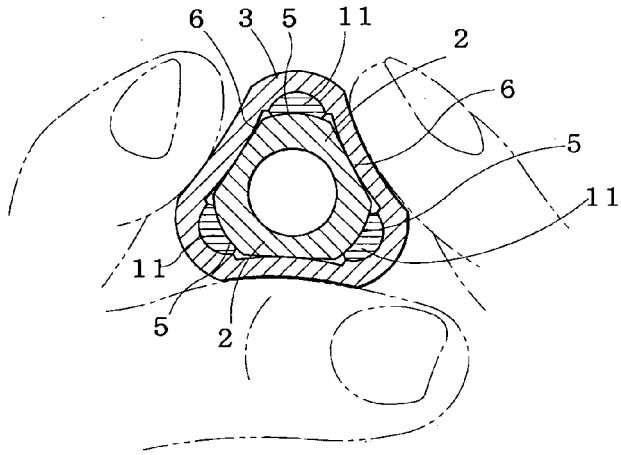
FIG. 12 is an explanatory view of the state of holding a grip body shown in FIG. 10.

As shown in FIG. 10, when the columnar bodies 11 are seated on the respective distant face portions 5, gaps 21 are formed between the grip body 3 and the retracting face portions 6. Since both end portions in the axial direction of the gaps 21 are substantially filled with the inner bearing member 13 and the second rotation-supporting portion 8 at the front portion of the grip-attaching portion 2, when the grip body 3 is grasped during use as shown in FIG. 12, an appropriate air cushion effect is obtained and a writing operation can easily be achieved.

Figure 13:
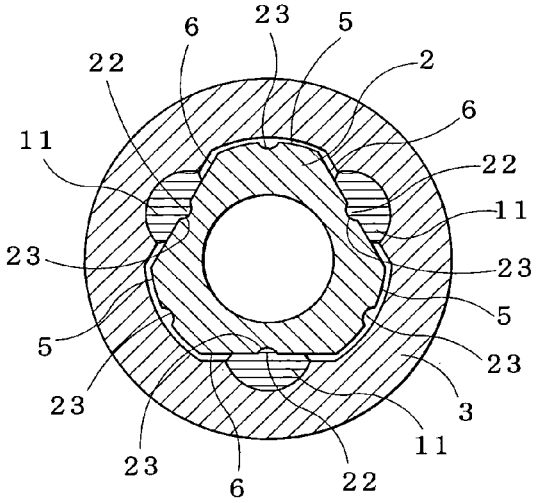
FIG. 13 is an explanatory view showing an example of a holding means.
Figure 14:
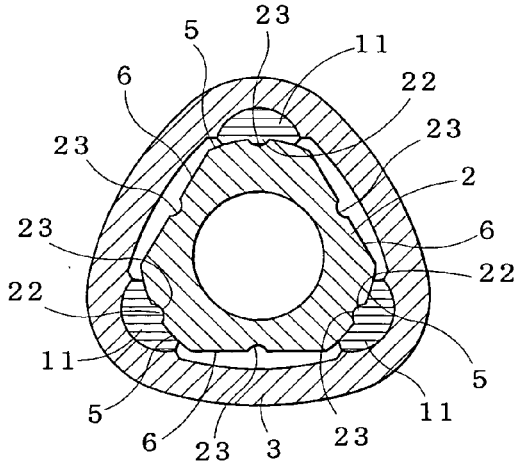
FIG. 14 is an explanatory view of a state in which the grip body is rotated from the position in FIG. 13.

FIG. 13 shows another example of the holding means for holding the grip body 3 at the rotated position. In FIG. 13, on each of the columnar bodies 11 of the grip body 3, an engagement projection 22 is provided, and on each of the retracting face portions 6 and the distant face portions 5 of the grip-attaching portion 2, a receiving portion 23 with which the corresponding engagement projection 22 engages is formed. When the grip body 3 rotates, the engagement projections 22 engage with the respective receiving portions 23 of the retracting face portions 6 as shown in FIG. 13, or engage with the respective receiving portions 23 of the distant face portions 5 as shown in FIG. 14, by which unwanted rotation of the grip body 3 can be controlled. Similarly to the above examples, the degree of engagement between the engagement projections 22 and the respective receiving portions 23 is such that the engagement can be detached or released when the grip body 3 is positively rotated. Alternatively, the engagement projections 22 may be provided on the grip-attaching portion 2, and the receiving portions 23 may be provided on the respective columnar bodies 11.

Figure 15:
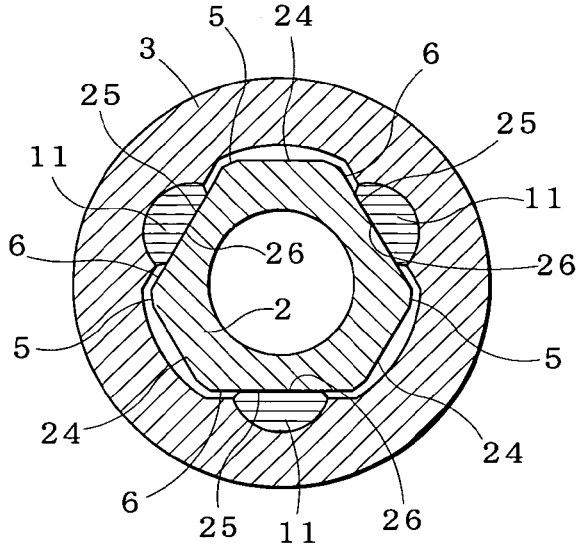
FIG. 15 is an explanatory view showing another example of the holding means.
Figure 16:
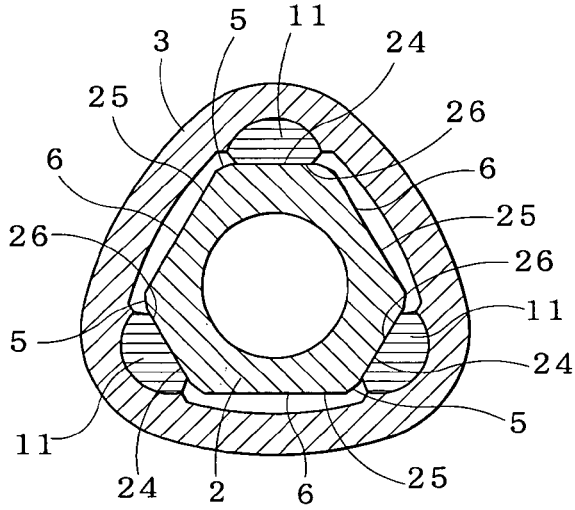
FIG. 16 is an explanatory view showing the state in which the grip body is rotated from the position shown in FIG. 15.

FIGS. 15-16 show another example of the holding means for holding the grip body 3 at the rotated position. In this embodiment, planar seating surfaces 24 and 25 are formed on the respective distant face portions 5 and the retracting face portions 6, respectively, and plane contact surfaces 26 are formed on the respective columnar bodies 11 for surface contact with the seating surfaces 24 and 25. By this construction, when the grip body 3 is rotated, under the condition that the planar seating surfaces 24 and 25 are in surface contact with the respective contact surfaces 26, the grip body 3 is held at the positions shown in FIGS. 15-16 in a stable manner.

Thus the hand-held instrument according to the present invention has a variable contour grip with a simple construction by which an outer configuration or contour of the grip body can be changed to a shape other than a circular shape and for which no pressing means for moving the grip body in the axial direction of the main body is required as compared to conventional hand-held instruments. The hand-held instrument of the present invention is also simple and economical to manufacture.

From the foregoing description, it can be seen that the present invention comprises an improved hand-held instrument. It will be appreciated by those skilled in the art that obvious changes can be made to the embodiment described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

I claim:

1. A hand-held instrument having a variable contour grip, the hand-held instrument comprising: a main body having a grip-attaching portion; and a tubular grip body made of a resilient material and disposed on the grip-attaching portion of the main body for undergoing rotation relative thereto, each of an outer circumferential surface of the grip-attaching portion and an inner circumferential surface of the grip body having a non-circular cross-sectional shape so that when the grip-attaching portion and the grip body are rotated relative to one another, the grip body undergoes deformation so that portions thereof are contracted and other portions thereof are expanded to thereby change an outer configuration or contour of the grip body; wherein the outer circumferential surface of the grip-attaching portion has at least one first surface portion spaced apart from a longitudinal axis of the main body and at least one second surface portion disposed closer to the longitudinal axis than the first surface portion; wherein the grip body has at least one columnar body protruding from an inner surface thereof and extending along the grip-attaching portion so that when the grip-attaching portion is rotated relative to the grip body, the columnar body can be seated on either the first surface portion or the second surface portion of the grip-attaching portion; and wherein the grip-attaching portion has a rotation-supporting portion having a circular outer configuration and the grip body has an inner bearing member disposed on the inner surface of the grip body, the inner bearing member having a tubular portion rotatably fitted to the rotation-supporting portion and integrally connected to a basal end of the columnar body.

2. A held-held instrument according to claim 1; wherein the at least one columnar body comprises a plurality of columnar bodies each having a front end portion connected to a generally ring-shaped connecting piece.

3. A hand-held instrument according to claim 1; wherein an engagement projection is formed on one of the rotation-supporting portion and the tubular portion of the inner bearing member; and wherein a receiving portion is formed on the other of the rotation-supporting portion and the tubular portion of the inner bearing member for receiving the engagement projection.

4. A hand-held instrument according to claim 1; wherein the first surface portion comprises an arcuate surface and the second surface portion comprises a planar surface.

5. A hand-held instrument according to claim 1; wherein the grip-attaching portion has a substantially equilateral triangular cross-section; and wherein the at least one first surface portion comprises three first surface portions formed by respective arcuate surfaces and the at least one second surface portion comprises three second surface portions formed by respective planar surfaces.

6. A hand-held instrument according to claim 1 wherein when the columnar body of the grip body is seated on the second surface portion, the outer circumferential surface of the grip body has a substantially circular cross-section.

7. A hand-held instrument according to claim 1; further comprising holding means disposed between the grip-attaching portion and the grip body for holding the grip body at a rotated position relative to the grip-attaching portion when the columnar body is seated on the first or second surface portion of the grip-attaching portion.

8. A hand-held instrument according to claim 7; wherein the holding means comprises an engagement projection formed on one of the grip-attaching portion and the grip body, and a receiving portion formed on the other of the grip-attaching portion and the grip body for receiving the engagement projection.

9. A hand-held instrument according to claim 8; wherein the holding means comprises an engagement projection formed on one of the tubular member and the grip body, and a receiving portion formed on the other of the tubular member and the grip body for receiving the engagement projection.

10. A hand-held instrument according to claim 9; wherein the engagement projection is formed on one of the protrusion of the grip body and the first and second surface portions of the tubular member; and wherein the receiving portion is formed on the other of the protrusion of the grip body and the first and second surface portions of the tubular member for receiving the engagement projection.

11. A hand-held instrument according to claim 8; wherein the engagement projection is formed on one of the columnar body and the first and second surface portions of the grip-attaching portion; and wherein the receiving portion is formed on the other of the columnar body and the first and second surface portions of the grip-attaching portion for receiving the engagement projection.

12. A hand-held instrument according to claim 7; wherein the holding means comprises a plurality of generally planar seating surfaces formed on the first and second surface portions of the grip-attaching portion, and a contact surface formed on the columnar body for surface-to-surface contact with the seating surfaces.

13. A hand-held instrument according to claim 1; wherein the hand-held instrument comprises a writing instrument.

14. A hand-held instrument having a variable contour grip, the hand-held instrument comprising:

a tubular member having an outer circumferential surface having a non-circular cross-sectional shape;

a tubular grip body made of a resilient material and disposed on the tubular member for undergoing rotation relative thereto, the grip body having an inner circumferential surface having a non-circular cross-sectional shape; and means for varying an outer configuration or contour of the grip body during rotation of the tubular member and the grip body relative to one another, the means for varying the outer configuration or contour of the grip body comprising first and second surface portions of the outer circumferential surface of the tubular member, and at least one protrusion extending inwardly from the inner circumferential surface of the grip body for alternatively contacting the first and second surface portions of the tubular member to vary the outer configuration or contour of the grip body, the first surface portion of the tubular member being generally arcuate and the second surface portion of the tubular member being generally planar.

15. A hand-held instrument according to claim 14; wherein the outer configuration or contour of the grip body is generally circular in cross-section when the protrusion of the grip body contacts the second surface portion of the tubular member and is generally non-circular in cross-section when the protrusion of the grip body contacts the first surface portion of the tubular member.

16. A hand-held instrument according to claim 14; wherein the protrusion is formed in one piece with the grip body.

17. A hand-held instrument according to claim 14; wherein the protrusion comprises a protruding member that is integrally connected to the inner circumferential surface of the grip body.

18. A hand-held instrument according to claim 14; further comprising holding means disposed between the tubular member and the grip body for holding the grip body at a rotated position relative to the tubular member when the protrusion contacts the first or second surface portion of the tubular member.

19. A hand-held instrument according to claim 18; wherein the holding means comprises a plurality of generally planar seating surfaces formed on the first and second surface portions of the tubular member, and a contact surface formed on the protrusion of the grip body for surface-to-surface contact with the seating surfaces.

20. A hand-held instrument according to claim 14; wherein the hand-held instrument comprises a writing instrument.

* * * * *